US006589045B2

(12) United States Patent
Xu

(10) Patent No.: US 6,589,045 B2
(45) Date of Patent: Jul. 8, 2003

(54) PIEZOELECTRIC JET LIGHTER FOR CIGARETTE, CIGAR AND PIPE

(75) Inventor: Wen Xu, El Monte, CA (US)

(73) Assignee: Zreative Products, Inc., El Monte, CA (US)

( * ) Notice: Subject to any disclaimer, the term of this patent is extended or adjusted under 35 U.S.C. 154(b) by 0 days.

(21) Appl. No.: 10/233,392

(22) Filed: Sep. 3, 2002

(65) Prior Publication Data

US 2003/0031969 A1 Feb. 13, 2003

Related U.S. Application Data

(63) Continuation-in-part of application No. 09/927,078, filed on Aug. 10, 2001, now abandoned.

(51) Int. Cl.[7] ..... F23Q 7/12

(52) U.S. Cl. ..... 431/255; 431/280; 431/281; 431/344

(58) Field of Search ..... 431/255, 344, 431/280, 281, 153, 132, 277

(56) References Cited

U.S. PATENT DOCUMENTS 5,584,681 A * 12/1996 Suzuki ..... 431/132

FOREIGN PATENT DOCUMENTS

| | | | | |
|---|---|---|---|---|
| GB | 2259755 | * | 3/1993 | ..... 431/277 |
| GB | 2260602 | * | 4/1993 | ..... 431/132 |
| JP | 06-281140 | * | 10/1994 | ..... 431/344 |
| JP | 6-300257 | * | 10/1994 | ..... 431/281 |

* cited by examiner

*Primary Examiner*—James C. Yeung
(74) *Attorney, Agent, or Firm*—Raymond Y. Chan; David & Raymond Patent Group

(57) ABSTRACT

A piezoelectric jet lighter is adapted for producing both jet flame and visible in order to selectively light a cigarette, a cigar, and a pipe. The piezoelectric jet lighter includes a gas ejecting pipe having a gas releasable valve connected to a jet nozzle for producing the jet flame and two gas emitting nozzles for producing the visible flames respectively. To operate the piezoelectric lighter, a downward force must be applied on an ignition button to ignite the lighter wherein the gas is emitted from the gas ejecting pipe to the jet flame to produce the jet flame. While the downward force is released, the gas releasable valve is automatically switched for allowing gas transported to the gas emitting nozzles to produce the visible flame.

22 Claims, 10 Drawing Sheets

PIEZOELECTRIC JET LIGHTER FOR CIGARETTE, CIGAR AND PIPE

CROSS-REFERENCE OF RELATED APPLICATION

This is a Continuation-In-Part application of a non-provisional application, application Ser. No. 09/927,078, filed Aug. 10, 2001, now abandoned.

BACKGROUND OF THE PRESENT INVENTION

1. Field of Invention

The present invention relates to a piezoelectric jet lighter, and more particularly to a piezoelectric jet lighter which provides a visible flame and a torch for selectively lighting a cigarette, a cigar, and a pipe.

2. Description of Related Arts

Piezoelectric lighters have been known and sold throughout the United States. The conventional piezoelectric lighters are generally classified into two categories which are the visible flame type piezoelectric lighter and the torch flame type piezoelectric lighter. The visible flame type piezoelectric lighter, such as a cigarette lighter, allows gas emitted from the nozzle directly burned in the air to produce a regular visible flame. The torch flame type piezoelectric lighter, such as a windproof lighter, provides a high temperature torch flame wherein an ignition element is heated up when igniting the lighter in such a manner that once the torch flame is blown out, the ignition element remains in high temperature and re-ignites the emitted gas to regain the torch flame.

For smokers, especially cigar and pipe smokers, do not ready like to use the torch flame type piezoelectric lighter since the high temperature torch flame will destroy the taste of the tobacco. However, it is a hassle for the smoker to light a cigarette or a cigar outdoors while using the visible flame type piezoelectric lighter. Thus, it is inconvenient for the smokers to carry two different types of lighter at once.

SUMMARY OF THE PRESENT INVENTION

A main object of the present invention is to provide a piezoelectric jet lighter which produces both visible flame and torch flame for selectively lighting a cigarette, cigar and pipe conveniently.

Another object of the present invention is to provide a piezoelectric jet lighter wherein the visible flame and the torch flame are selectively produced by controlling the ignition button such that no mechanism is required for users to manipulate in order to select the flame.

Another object of the present invention is to provide a piezoelectric jet lighter which does not require to alter the original structural design of the piezoelectric lighter so as to minimize the manufacturing cost of the piezoelectric lighter.

Accordingly, in order to accomplish the above objects, the present invention provides a piezoelectric jet lighter for cigarette, cigar and pipe, comprising:

a casing having a liquefied gas storage;

a nozzle housing provided on a ceiling of the casing;

a jet nozzle received in the nozzle housing and communicating with the liquefied gas storage for producing a jet flame, wherein an ignition element is mounted on an opening of the nozzle housing at a position above the jet nozzle;

a gas ejecting pipe having a gas releasable valve extended from the liquefied gas storage for controlling a flow of gas to the jet nozzle wherein a gas emitting conduit is extended from the gas releasable valve to the jet nozzle;

a piezoelectric unit, which is disposed in the casing for generating piezoelectricity, comprising a movable operating part extended upwardly and an ignition tip extended to a position closed with the jet nozzle, wherein when the movable operating part is depressed downwardly, sparks are generated from the ignition tip to ignite the gas emitted from the jet nozzle and heat up the ignition element at the same time;

an ignition button slidably mounted on the ceiling of the casing in a vertical movable manner wherein the ignition button is attached to a top end of the piezoelectric unit and arranged in such a manner that when the ignition button is depressed downwardly, the movable operating part of the piezoelectric unit is depressed to ignite the piezoelectric jet lighter;

a lighter cap slidably mounted on the ceiling of the casing in such a radially movable manner for covering the opening of the nozzle housing in an air tight manner; and a visible flame arrangement, comprising:

a pair of gas emitting nozzles appearing on the nozzle housing for producing visible flames respectively; and a connecting means comprising a gas passage conduit extended from the gas releasable valve, a pair of gas discharging conduits extended from the gas emitting nozzles respectively, and a gas dividing valve connected between the gas passage conduit and the gas discharging conduits for detouring the gas passing from the gas passage conduit to the gas discharging conduits and the gas emitting nozzles individually.

In addition, the two gas emitting nozzles are respectively provided on a ceiling of the nozzle housing and positioned at two sides of the jet nozzle, wherein each of the gas emitting nozzles is an elongated tube vertically extended through the nozzle housing to a position closed with the ignition element in such a manner that when the ignition element is heated up, the gas emitted from the respective gas emitting nozzle is ignited to produce the visible flame.

DETAILED DESCRIPTION OF THE PREFERRED EMBODIMENT

Figure 1:
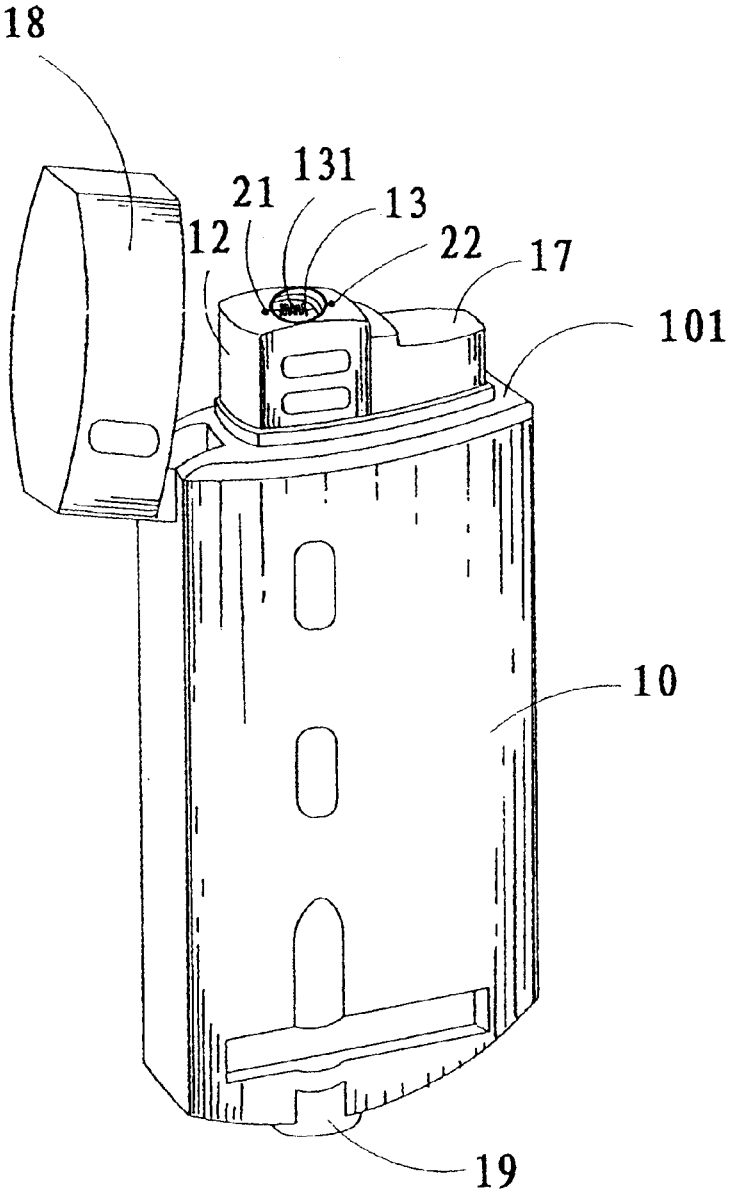
FIG. 1 is a perspective view of a piezoelectric jet lighter for cigarette, cigar and pipe according to a first preferred embodiment of the present invention.

Referring to FIG. 1 of the drawings, a piezoelectric jet lighter according to a preferred embodiment of the present invention is illustrated, wherein the piezoelectric jet lighter is adapted for providing both torch flame and visible flame for selectively lighting a cigarette, cigar, and pipe.

Figure 2:
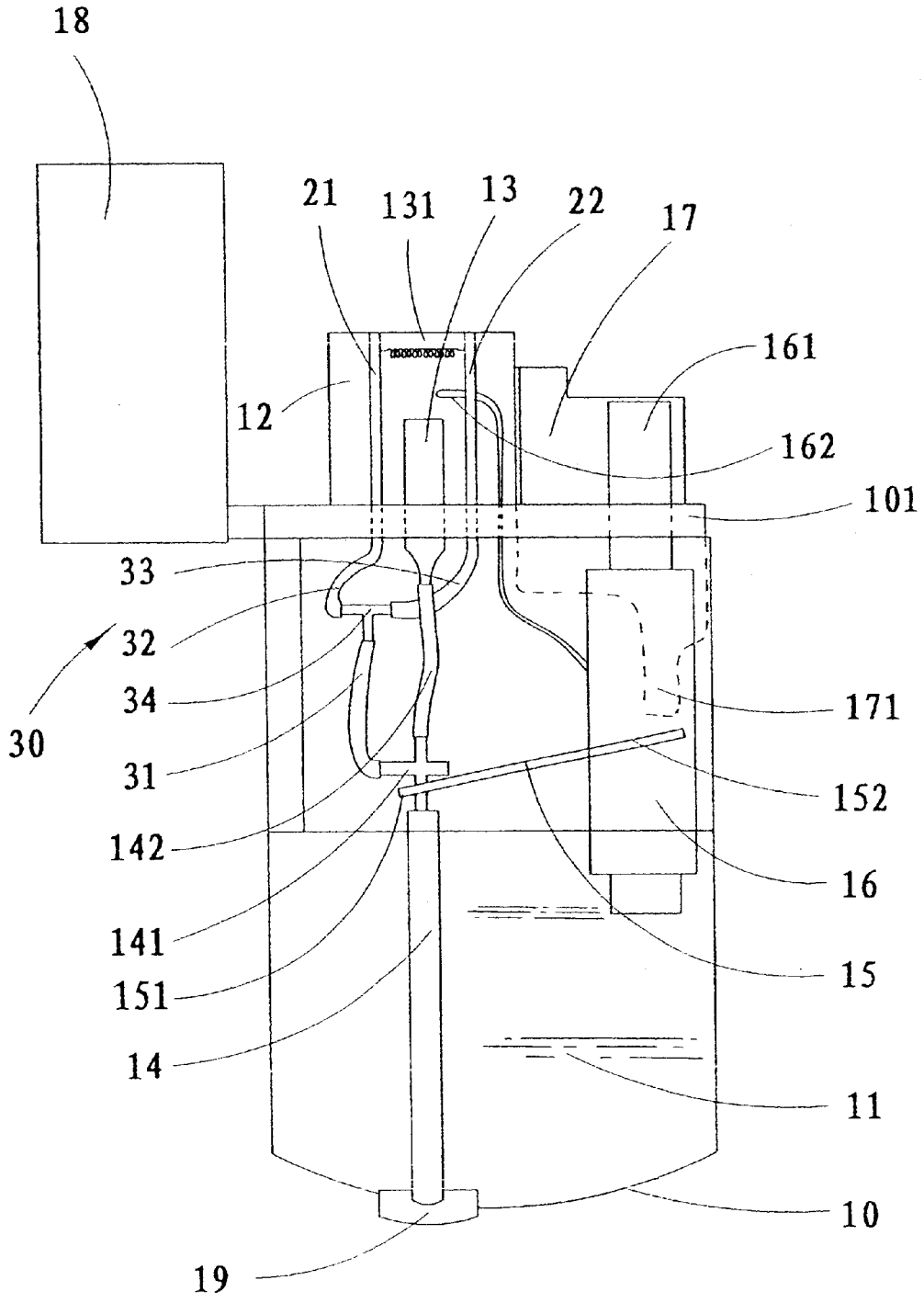
FIG. 2 is a sectional view of the piezoelectric jet lighter for cigarette, cigar and pipe according to the above first preferred embodiment of the present invention.

As shown in FIG. 2, the piezoelectric jet lighter comprises a casing 10 having a gas liquefied storage 11, a nozzle housing 12 provided on a ceiling 101 of the casing 10, a jet nozzle 13 received in the nozzle housing 12 and communicating with the gas liquefied storage 11 for producing a jet flame wherein an ignition element 131 is mounted on an opening of the nozzle housing 12 at a position above the jet nozzle 13, and a gas ejecting pipe 14 having a gas releasable valve 141 extended from the gas liquefied storage 11 for controlling a flow of gas wherein a gas emitting conduit 142 is extended from the gas releasable valve 141 to the jet nozzle 13 for transporting the gas therebetween.

The ignition element 131 is made of high temperature resistance material (incandescent material) such as platinum wherein the ignition element 131 is adapted for being heated up at an extremely high temperature within a short period of time. So, once the ignition element 131 is heated up, the ignition element 131 having enough high temperature can re-ignite the gas emitted from the jet nozzle 13 to keep providing the torch flame from the piezoelectric jet lighter.

A gas lever 15, which is disposed in the casing 10 in a pivotal movable manner, has an engaging end 151 engaged with the gas releasable valve 141 and a depressible end 152 arranged in such a manner that when the depressible end 152 of the gas lever 15 is depressed downwardly, the engaging end 151 of the gas lever 15 lifts up the gas releasable valve 141 for releasing gas.

A piezoelectric unit 16, which is disposed in the casing 10 for generating piezoelectricity, comprising a movable operating part 161 extended upwardly and an ignition tip 162 extended to a position closed with the jet nozzle 13, wherein when the movable operating part 161 is depressed downwardly, sparks are generated from the ignition tip 162 to ignite the gas emitted from the jet nozzle 13 at the same time.

An ignition button 17 is slidably mounted on the ceiling 101 of the casing 10 in a vertical movable manner and is attached to a top end of the movable operating part 161 of the piezoelectric unit 16, wherein the ignition button 17 has a depressing arm 171 downwardly extended to rest on the depressible end 152 of the gas lever 15 in such a manner that when the ignition cap 17 is depressed downwardly, the movable operating part 161 of the piezoelectric unit 16 and the depressible end 152 of the gas lever 15 are respectively depressed at the same time to ignite the piezoelectric jet lighter.

A lighter cap 18 is slidably mounted on the ceiling 101 of the casing 10 in such a radially movable manner for covering the opening of the nozzle housing 12 in an airtight manner.

Moreover, the lighter cap 18 further comprises a switching arm extended to the gas releasable valve 14 and arranged in such a manner that when the lighter cap 18 is radially and outwardly slid with respect to the casing 10 to expose the jet nozzle 13 to outside, the switching arm is driven to lift up the gas releasable valve 14, so that the gas in the gas liquefied storage 11 is allowed to release through the jet nozzle 13 when the depressible end 152 of the gas lever 15 is depressed downwardly. In other words, the lighter cap 18 functions as a main valve switch for controlling the gas releasing from the gas liquefied storage 11 such that when the lighter cap 18 is radially slid on top of the nozzle housing 12 to enclose the jet nozzle 13, the gas releasable valve 141 is closed to stop the gas releasing therethrough.

The piezoelectric jet lighter further comprises a visible flame arrangement 20 which comprises at least two gas emitting nozzles 21, 22 and a connecting means 30 for connecting between the two gas emitting nozzles 21, 22 and the gas releasable valve 141.

According to the preferred embodiment, a pair of gas emitting nozzles 21, 22 are appearing on the nozzle housing 12 for producing visible flames respectively. The two gas emitting nozzles 21, 22 are respectively provided on a ceiling of the nozzle housing 12 and positioned at two sides of the jet nozzle 13. Each of the gas emitting nozzles 21, 22 is an elongated tube vertically extended through the nozzle housing 12 to a position closed with the ignition element 141 in such a manner that when the ignition element 141 is heated up, the gas emitted from the respective gas emitting nozzle 21, 22 is ignited to produce the visible flame.

The connecting means 30 comprises a gas passage conduit 31 extended from the gas releasable valve 141, a pair of gas discharging conduits 32, 33 extended from the gas emitting nozzles 21, 22 respectively, and a gas dividing valve 34 connected between the gas passage conduit 31 and the gas discharging conduits 32, 33 for detouring the gas passing from the gas passage conduit 31 to the gas discharging conduits 32, 33 and the gas emitting nozzles 21, 22 individually.

Accordingly, the releasable valve 141 is a T-shaped valve joint having a gas inlet 141A extended from the gas ejecting pipe 14 and two gas outlets 141B, 141C connected with the gas emitting conduit 142 and the gas passage conduit 31 respectively for selectively switching the gas discharged from the gas ejecting pipe 14 to be detoured either through the gas emitting conduit 142 for the jet nozzle 13 to produce the jet flame or the gas passage conduit 31 for the gas emitting nozzle 21, 22 to produce the visible flame. In other words, the gas discharged from the gas ejecting pipe 14 is detoured to either the gas emitting conduit 142 for the jet nozzle 13 to produce the torch flame or the gas passage conduit 31 for the gas emitting nozzle to produce the visible flame automatically.

The gas dividing valve 34 is a tee joint valve preferably made of plastic wherein the gas dividing valve 34 has a gas entrance 341 connected to the gas passage conduit 31 and two gas exits 342, 343 connected to the gas discharging conduits 32, 33 such that gas discharged from the gas passage conduit 31 is evenly divided into two portions to the two gas emitting nozzles 21, 22 respectively. So, each of the gas emitting nozzles 21, 22 functions individually since the discharged gas transported to the emitting nozzles 21, 22 are supported by the gas discharging conduits 32, 33 separately.

The piezoelectric jet lighter further comprises a gas adjustable button 19 rotatably connected to the gas ejecting pipe 14 for selectively adjusting a flow of gas. The gas adjustable button 19 is rotatably mounted at a bottom of the casing 10 and arranged to adjust the flow of gas discharging from the gas ejecting pipe 14. It is worth to mention that the same amount of emitted gas is ignited to produce the jet flame and the visible flame since the emitted gas is transported from the gas ejecting pipe 14. So, by turning the gas adjustable button 19, both volumes of the jet flame and the visible flame are adjusted at the same time, so as to prevent one of the flames are bigger than the other.

Figure 4:
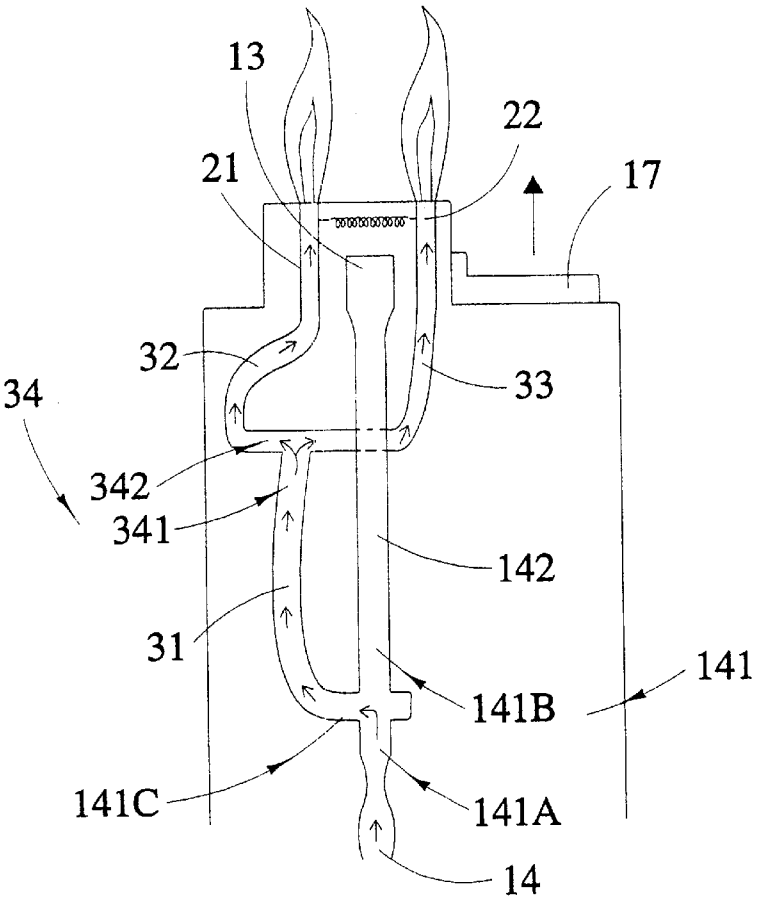
FIG. 4 is a partially sectional view of the piezoelectric jet lighter producing a visible flame according to the above first preferred embodiment of the present invention.
Figure 3:
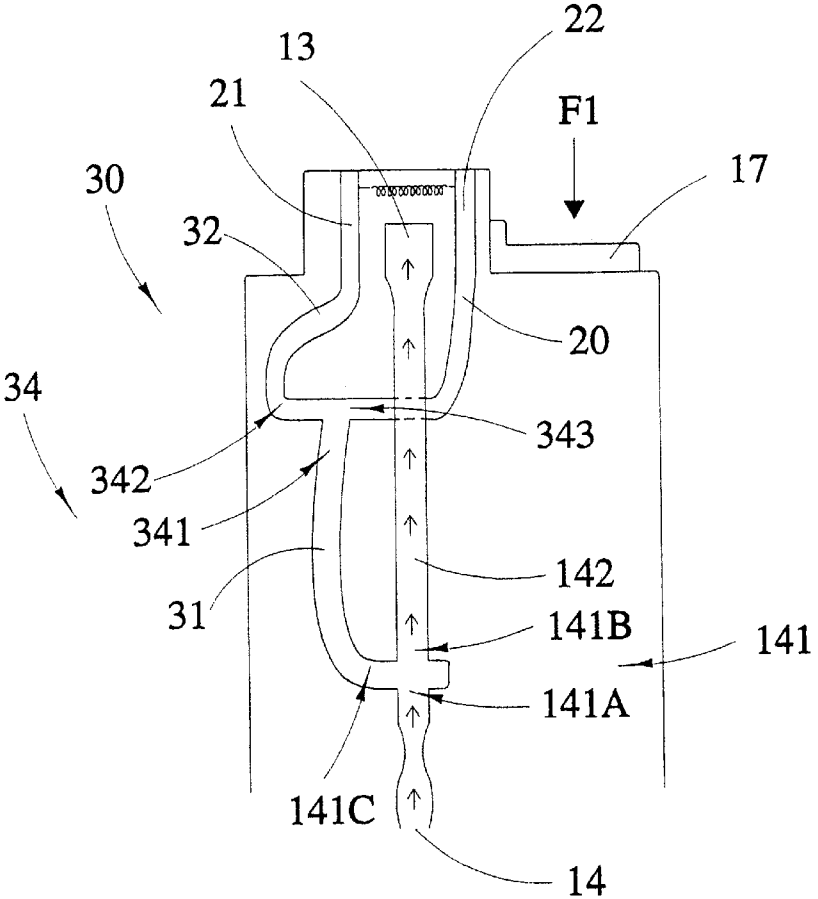
FIG. 3 is a partially sectional view of the piezoelectric jet lighter producing a jet flame according to the above first preferred embodiment of the present invention.

To operate the piezoelectric jet lighter, a downward force F1 must be intentionally applied on the ignition button 17 to compress the piezoelectric unit 16 for striking spark and ignite the piezoelectric jet lighter. At the same time, the emitted gas from the gas ejecting pipe 14 is transported through the gas emitting conduit 142 to the jet nozzle 13 for producing the jet flame, as shown in FIG. 3. While releasing the downward force F1 on the ignition button 17, the compressed piezoelectric unit 16 will rebound to its original form which pushes the ignition button 17 back to its original position. The emitted gas will then be detoured from the gas ejecting pipe 14 through the gas passage conduit 31 to the gas emitting nozzles 21, 22 respectively for producing visible flames, as shown in FIG. 4. Once the lighting operation is finished, a user can slidably push the lighter cap 18 back on the ceiling 101 of the casing 10 so as to cover the nozzle housing 12. It is worth to mention that the visible flames require air from surroundings for combination. So, when the lighter cap 18 is covered on the nozzle housing 12, no air is supplied for the combination of the visible flames so as to extinguish the visible flames from the piezoelectric jet lighter.

Figure 5A:
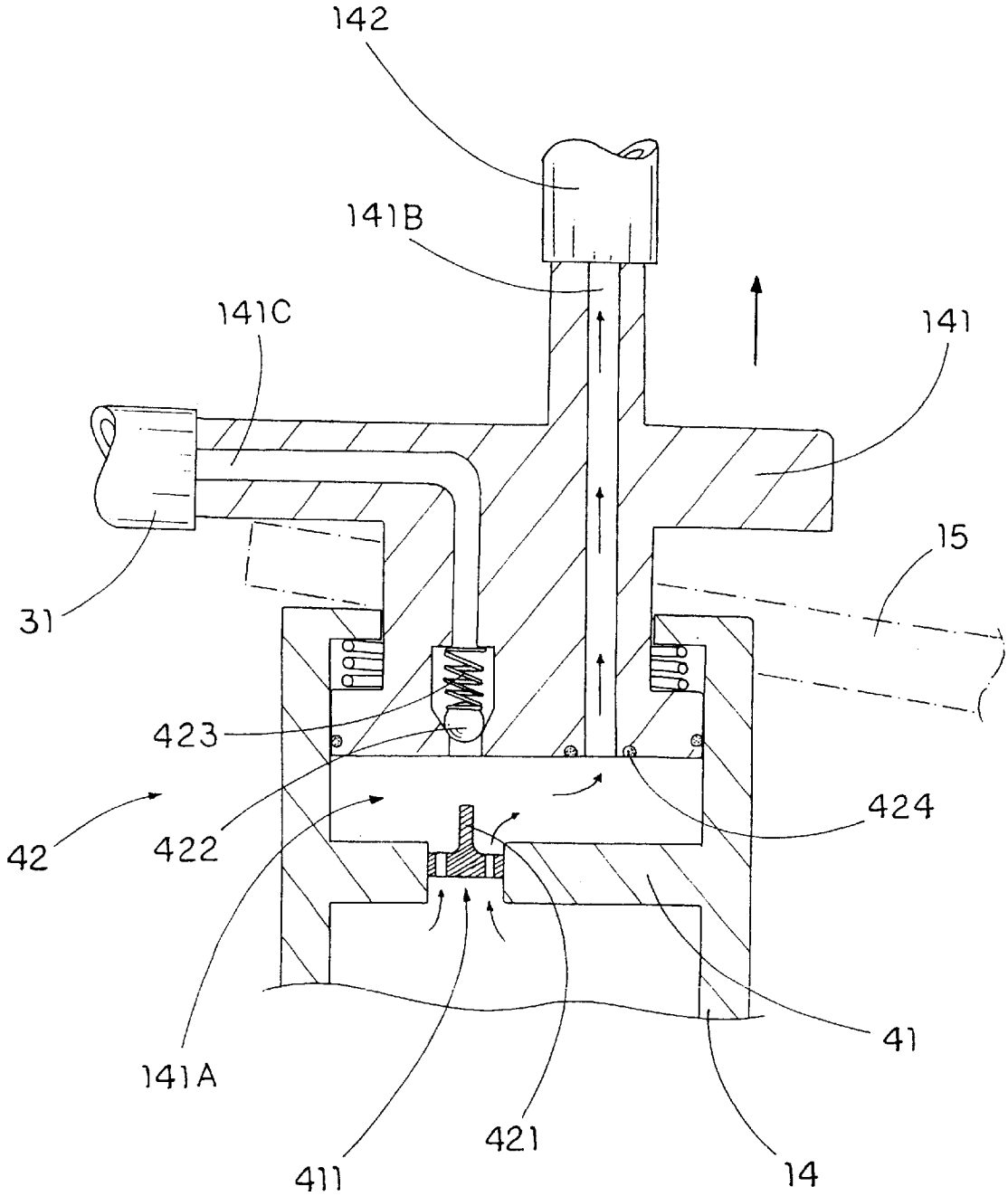
FIGS. 5A and 5B are sectional views of a gas releasable valve of the piezoelectric jet lighter according to the above first preferred embodiment of the present invention.
Figure 5B:
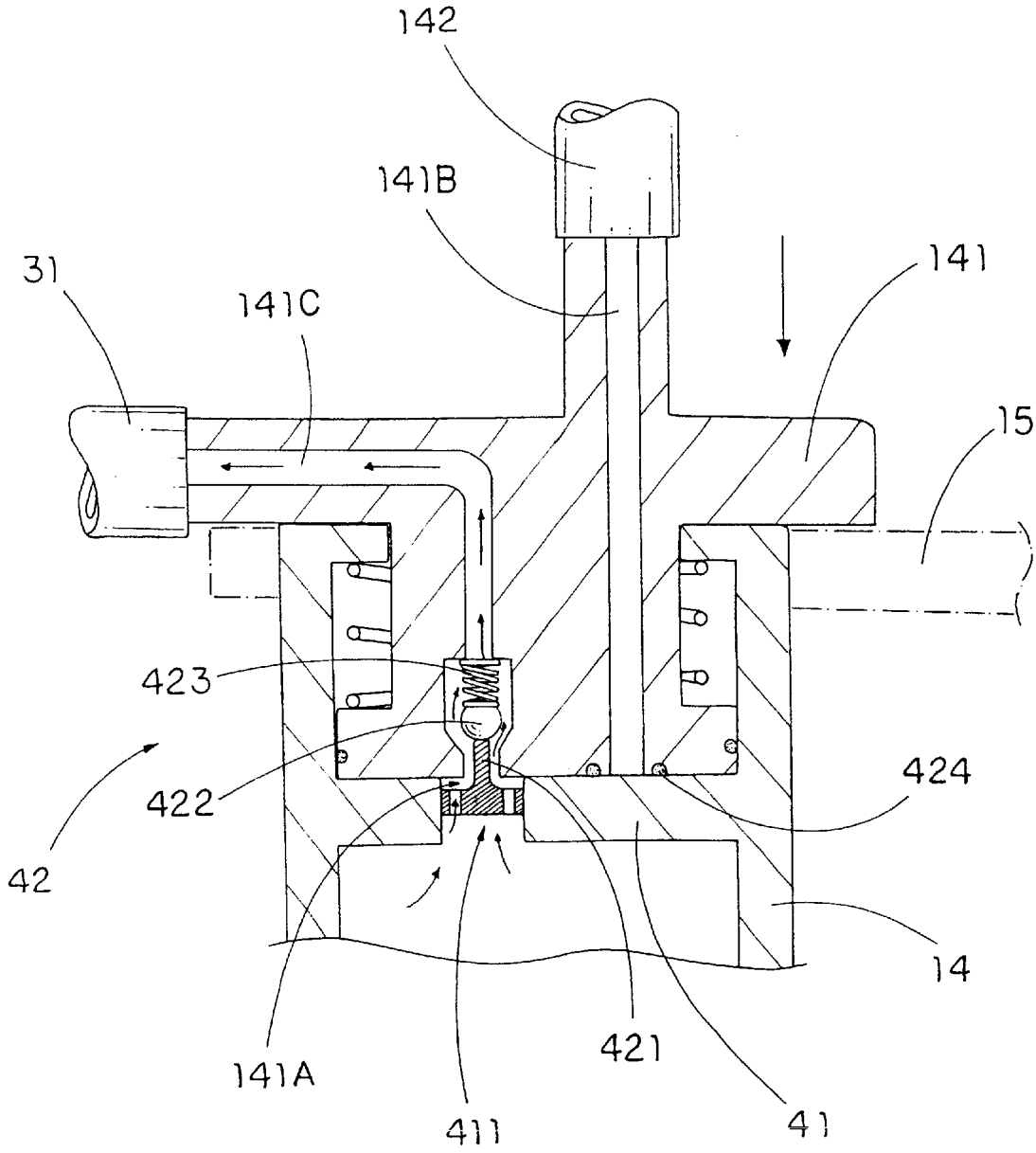

Referring to FIGS. 5A and 5B, a mechanism of the gas releasable valve 141 is illustrated, wherein the gas releasable valve 141 is a conventional gas releasable valve that allows to detour the flow of gas discharging from one gas outlet to another outlet by the valve position. Therefore, the gas releasable valve 141 of the present invention is a reference to illustrate one of the alternatives of the conventional gas releasable valve.

As shown in FIG. 5A, the gas releasable valve 141 further comprises a sealing wall 41, having a gas passage 411, sealedly mounted at the gas ejecting pipe 14 and means 42 for selectively regulating the gas discharged from the gas ejecting pipe 14 to one of the gas outlets 141B, 141C in accordance with a vertical movement of the gas releasable valve 141.

Accordingly, the regulating means 42 comprises a gas releasable pusher 421 supported at the gas passage 411, a gas stopper 422, having a spherical shaped, mounted at an entrance of the gas outlet 141C that communicates with the gas passage conduit 31, and a compression spring 423 supported at the entrance of the respective gas outlet 141 for applying an urging pressure against the gas stopper 422 so as to block the gas flowing towards the gas passage conduit 31 in such a manner that when the gas releasable valve 141 is lifted up, the gas stopper 422 blocks the gas flowing towards the gas passage conduit 31 so that the gas is released through the gas passage 411 and detoured to flow towards the gas emitting conduit 142 through the respective gas outlet 141B communicating therewith, as shown in FIG. 5A.

However, when the gas releasable valve 141 is dropped down, a bottom side of the gas inlet 141A is sealedly supported on the sealing wall 41 to block the gas flowing towards the gas emitting conduit 142. At the same time, the gas releasable pusher 421 pushes the gas stopper 422 upwardly to release the blocking of the respective gas outlet 141C so that the gas is released through the gas passage 411 and detoured to flow towards the gas passage conduit 31 through the gas outlet 141C communicating therewith, as shown in FIG. 5B. Preferably, a sealing ring 424 is encirclingly mounted around an entrance of the gas outlet 141B that communicates with the gas emitting conduit 142 such that when the gas releasable valve 141 is dropped down, the sealing ring 424 is sealedly mounted on the sealing wall 41 so as to further ensure the blockage of the gas discharged to the gas emitting conduit 142.

Figure 6:
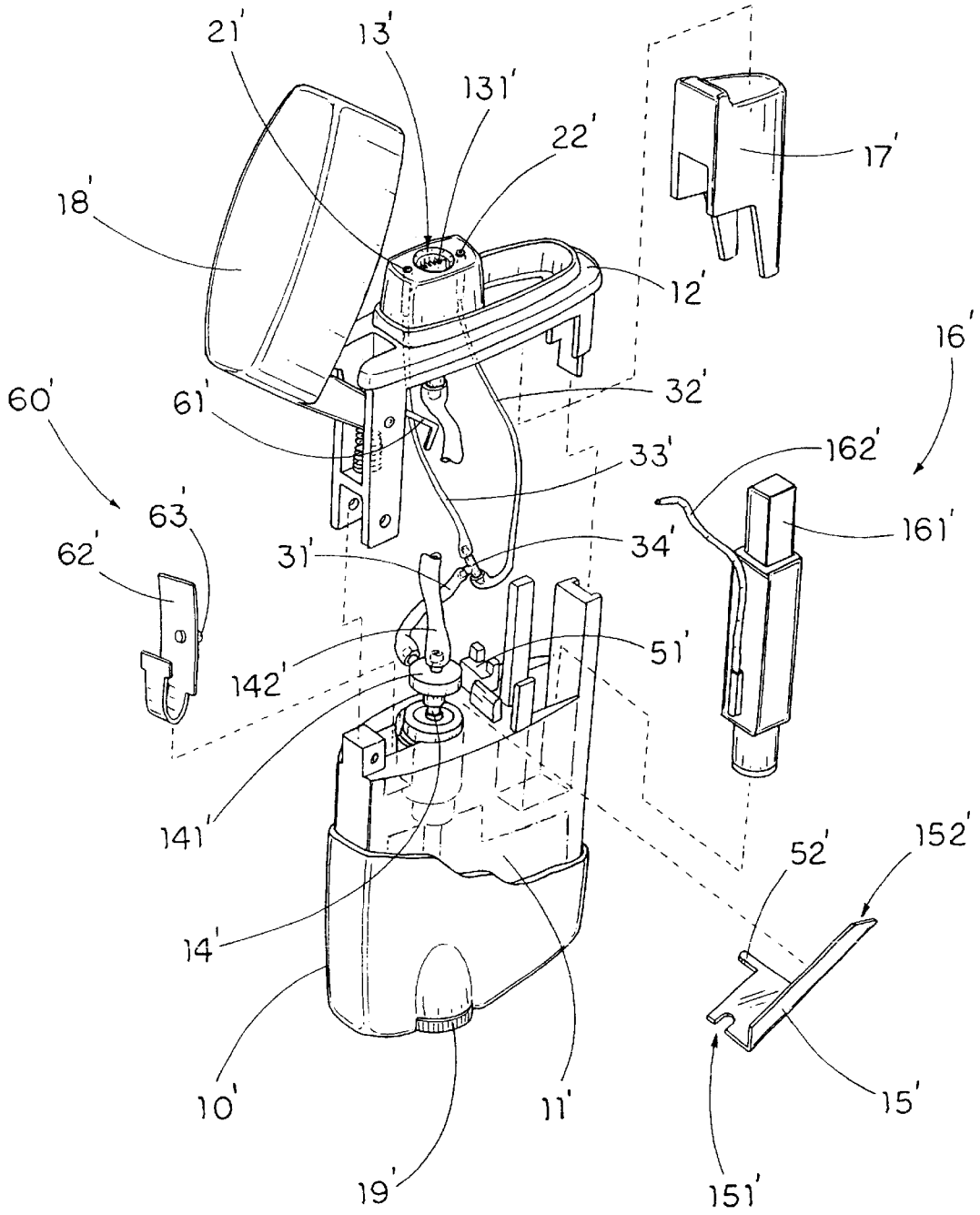
FIG. 6 is an exploded perspective view of a piezoelectric jet lighter for cigarette, cigar and pipe according to a second preferred embodiment of the present invention.

As shown in FIG. 6, a piezoelectric jet lighter of a second embodiment illustrates an alternative mode of the first embodiment of the present invention, wherein the components of the piezoelectric jet lighter of the second embodiment are the same of that of the first embodiment, except the structural design of the gas releasable gas 141' for selectively detouring the gas discharged to produce either the jet flame or the visible flame.

Figure 7:
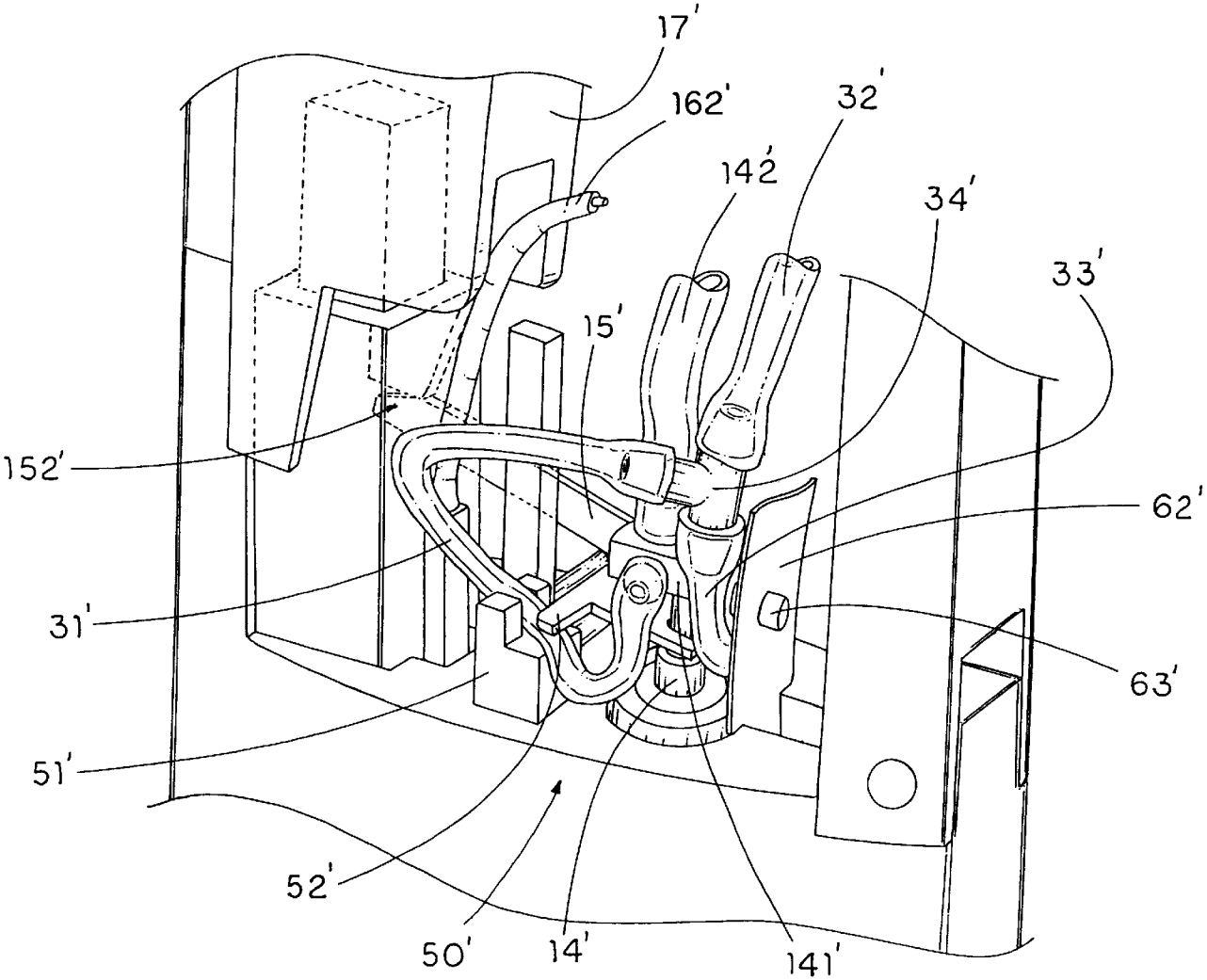
FIG. 7 is a partially perspective view of the piezoelectric jet lighter according to the above second preferred embodiment of the present invention.

As shown in FIGS. 6 and 7, the piezoelectric jet lighter further comprises a gas detouring arrangement 50' comprising a passage seat 51' supported in the casing 10' while the gas passage conduit 31' is rested on the passage seat 51', and a control latch 52' extended from the gas lever 15' to a position above the passage seat 51' in such a manner that when the depressible end 152' of the gas lever 15' is depressed to drive the control latch 52' downwardly, the control latch 52' compresses the gas passage conduit 31' with respect to the passage seat 51', so as to block the gas discharging through the gas passage conduit 31'.

It is worth mentioning that when the ignition button 17' is depressed downwardly to lift up the gas releasable valve 141' for releasing gas, the gas discharged from the gas ejecting pipe 14' is detoured to the gas emitting conduit 142' towards the jet nozzle 13' since the gas passage conduit 31' is compressed by the control latch 52' to block the gas passing through.

However, when the gas releasable valve 141' is drop downwardly to release the blocking up of the gas passage conduit 31' by the control latch 52', the gas discharged from the gas ejecting pipe 14' is detoured to the gas passage conduit 31' towards the gas emitting nozzles 21', 22' through the gas discharging conduits 32', 33' via the gas dividing valve 34'.

Accordingly, in order to produce the jet flame, the jet nozzle 13' has a plurality of micro nozzles for the gas discharging therethrough towards the ignition element 131', wherein each of the micro nozzles has a diameter less than 0.1 mm. According to the fluid mechanism, the gas tends to flow with less resistance. Therefore, when both of the gas passage conduit 31' and the gas emitting conduit 142' are allowed for the gas passing therethrough, the gas discharged from the gas ejecting pipe 14' has a tendency to flow towards the gas passage conduit 31' rather than the gas emitting conduit 142'. For example, 99% of the gas discharged from the gas ejecting pipe 14' will flow to the gas passage conduit 31' while 1% of the gas will flow to the gas emitting conduit 142'.

The piezoelectric jet lighter further comprises a gas adjustable button 19' rotatably connected to the gas ejecting pipe 14' for selectively adjusting a flow of gas. The gas adjustable button 19' is rotatably mounted at a bottom of the casing 10' and arranged to adjust the flow of gas discharging from the gas ejecting pipe 14'.

Figure 8A:
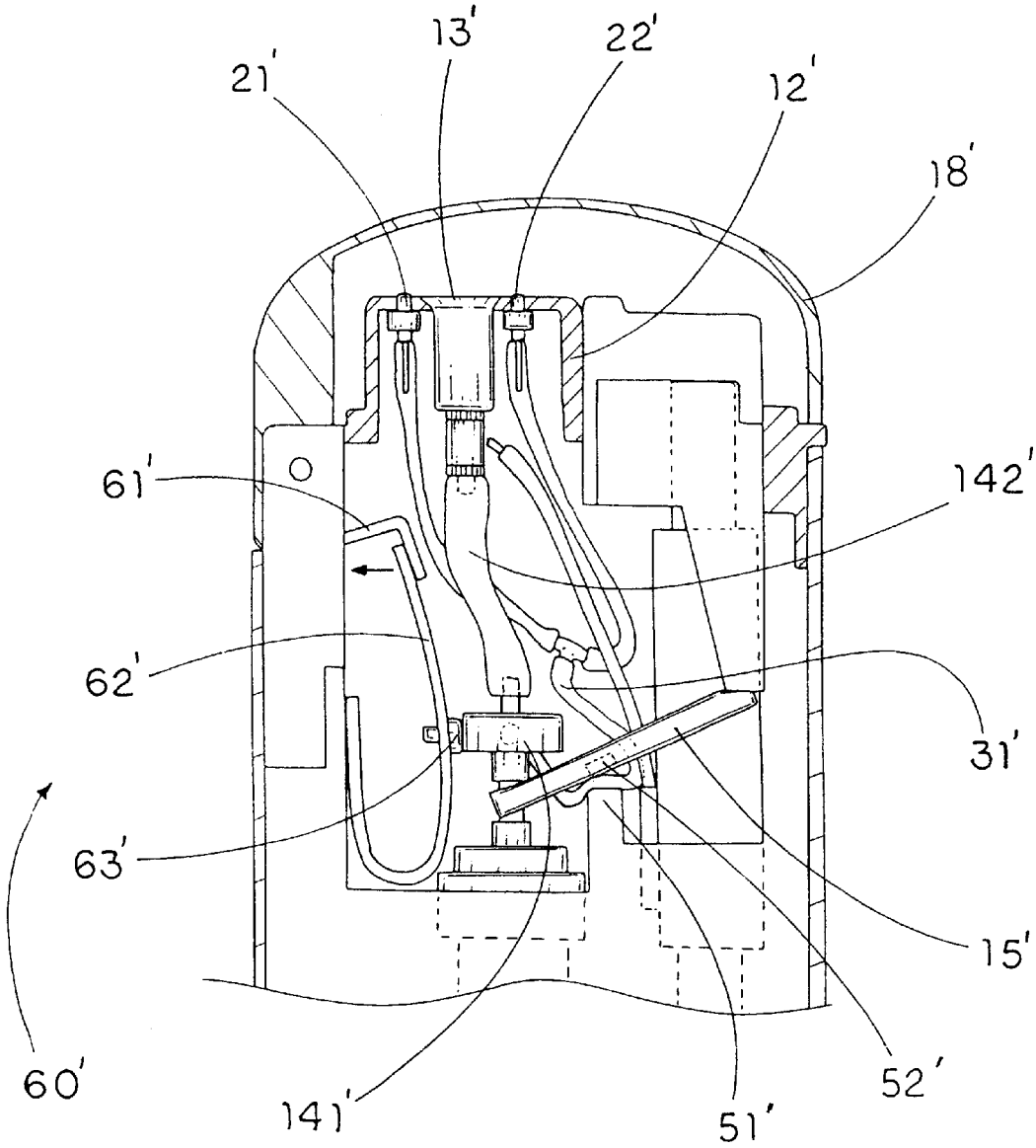
FIGS. 8A through 8C illustrates the mechanism for adjusting a position of the gas releasable valve of the piezoelectric jet lighter according to the above second preferred embodiment of the present invention.
Figure 8B:
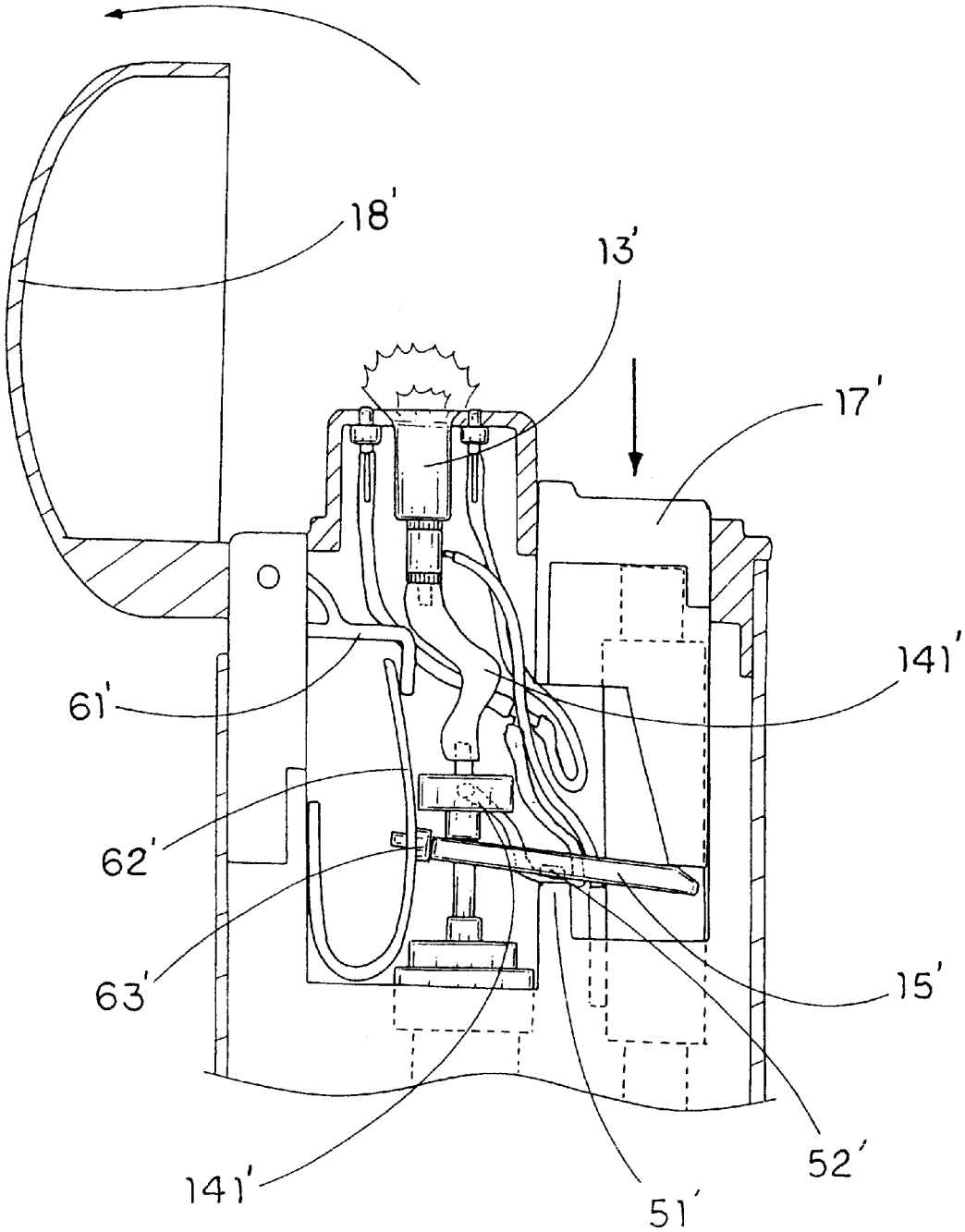
Figure 8C:
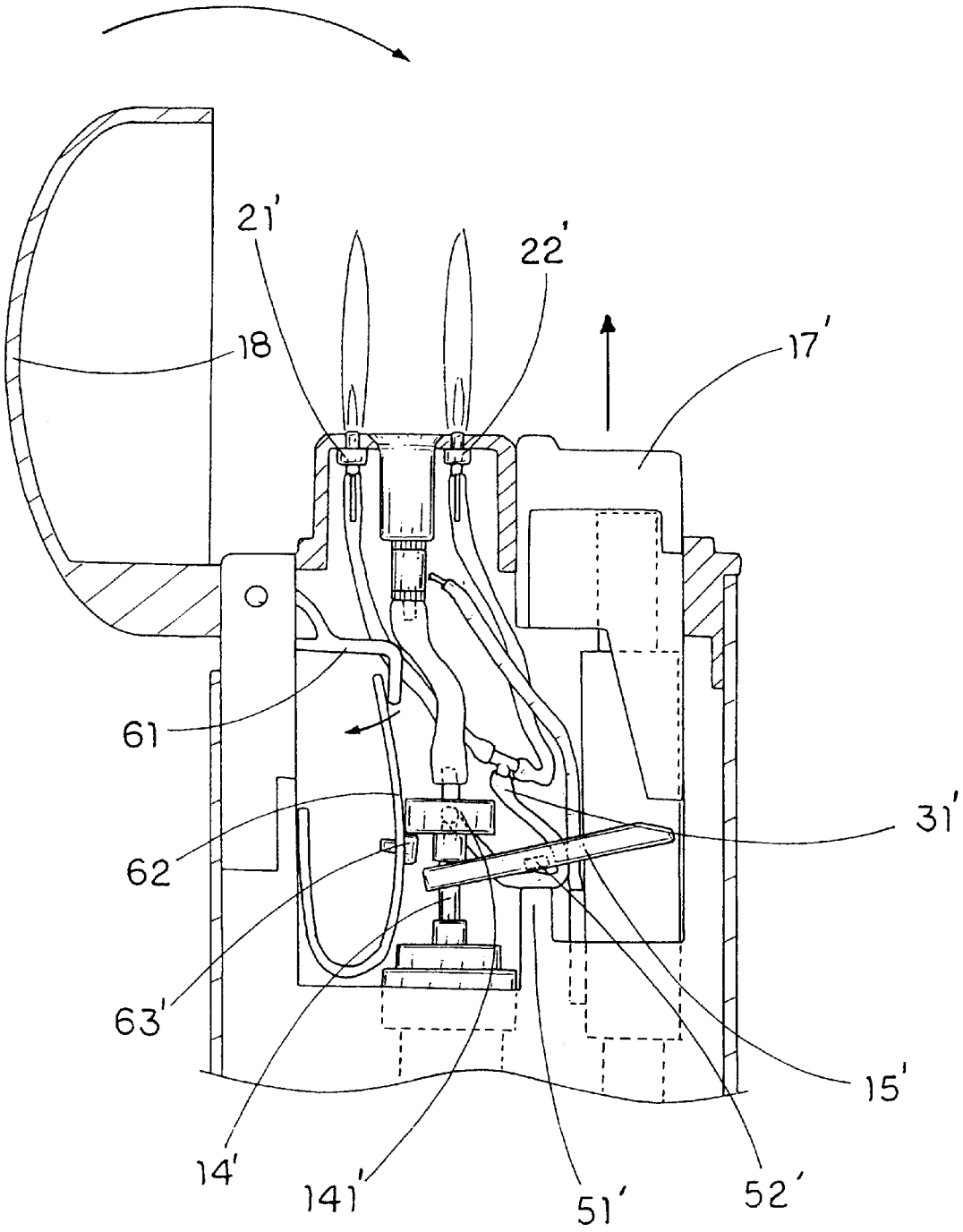

As shown in FIGS. 8A through 8C, the piezoelectric jet lighter further comprises a valve positioning arrangement 60' which comprises a switch latch 61' extended from the lighter cap 18' and arranged to be moved frontwardly when the lighter cap 18' is radially slid rearwardly with respect to the casing 10', a resilient element 62' having an affixing end portion securely mounted in the casing 10' and a control end portion engaged with the switch latch 61', and a switch pusher 63' mounted on the resilient element 62' at a position towards the gas releasable valve 141'.

As shown in FIG. 8A, the resilient element 62' is a U-shaped elastic clip supported in the casing 10' wherein when the lighter cap 18' is in a closed position that covers on the ceiling of the nozzle housing 12', the switch latch 61' normally pulls the control end portion of the resilient element 62' towards the affixing end portion thereof to retain the resilient element 62' in a compressed manner. Moreover, the resilient element 62' is adapted to apply a pushing force against the switch pusher 63' so as to push the switch pusher 63' to bias a sidewall of the gas releasable valve 141'.

FIG. 8B illustrates that when the lighter cap 18' is radially slid rearwardly to expose the ceiling of the nozzle housing 12' to outside, the switch latch 61' is moved frontwardly to release the compression of the resilient element 62'. When the ignition button 17' is depressed downwardly to lift up the gas releasable valve 141' via the gas lever 15', the switch pusher 63' is forced to move frontwardly at a position underneath the gas releasable valve 141'. At the same time, the gas passage conduit 31' is compressed by the control latch 52' so that the gas discharged from the gas ejecting pipe 14' is detoured to the gas emitting conduit 142' for the jet nozzle 13' to produce the jet flame.

FIG. 8C illustrates that while releasing the ignition button 17', the gas releasable valve 141' is dropped downwardly. However, the switch pusher 63' biases against a bottom side of the gas releasable valve 141' to block a downward movement of the gas releasable valve 141' back to its original position. At the same time, the control latch 52' is moved upwardly to release the blocking up of the gas passage conduit 31' so that the gas discharged from the gas ejecting pipe 14' is detoured to the gas passage conduit 31' for the gas emitting nozzles 21', 22' to produce the visible flames.

In addition, when the lighter cap 18' is radially slid back on the casing 10' to close the nozzle housing 12', the switch latch 61' is driven to pull the control end portion of the resilient element 62' rearwardly so as to rearwardly move the switch pusher 63' away from the gas releasable valve 141'. Therefore, the gas releasable valve 141' will further drop down to its original position to shut off the gas discharged from the gas ejecting pipe 14', as shown in FIG. 8A.

In other words, when the gas releasable valve 141' is in the lowest position, no gas is released from the gas liquefied storage 11'. When the gas releasable valve 141' is moved to the highest position via the gas lever 15', the piezoelectric jet lighter produces the jet flame. When the gas releasable valve 141' is moved to a mid-position that between the highest and lowest position, i.e. the gas releasable valve 141' is blocked by the switch pusher 63', the piezoelectric jet lighter produces the visible flames.

Accordingly, the ignition operation the piezoelectric jet lighter comprises the following steps.

(1) Open the lighter cap 18' to release the compression of the resilient element 62' via the switch latch 61'.

(2) Apply the downward force on the ignition button 17' to lift up the gas releasable valve 141' via the gas lever 15' such that the gas discharged from the gas ejecting pipe 14' is detoured to the gas emitting conduit 142' for the jet nozzle 13' to produce the jet flame.

(3) Release the downward force on the ignition button 17', such that the gas releasable valve 141' is dropped downwardly until the gas releasable valve 141' is blocked by the switch pusher 61', wherein the gas discharged from the gas ejecting pipe 14' is detoured to the gas passage conduit 31' for the gas emitting nozzles 21', 22' to produce the visible flames.

(4) Close the lighter cap 18' such that the switch latch 61' compresses the resilient element 62' to rearwardly move the switch pusher 63' away from the gas releasable valve 141', wherein the gas releasable valve 141' is allowed to further drop downwardly to its original position to shut off the gas discharged from the gas ejecting pipe 14'.

What is claimed is:

1. A piezoelectric jet lighter for cigarette, cigar and pipe, comprising:

a casing having a liquefied gas storage;

a nozzle housing provided on a ceiling of said casing;

a jet nozzle received in said nozzle housing and communicating with said liquefied gas storage for producing a jet flame, wherein an ignition element is mounted on an opening of said nozzle housing at a position above said jet nozzle;

a gas ejecting pipe having a gas releasable valve extended from said liquefied gas storage for controlling a flow of gas wherein a gas emitting conduit is extended from said gas releasable valve to said jet nozzle;

a piezoelectric unit, which is disposed in said casing for generating piezoelectricity, comprising a movable operating part extended upwardly and an ignition tip extended to a position closed with said jet nozzle, wherein when said movable operating part is depressed downwardly, sparks are generated from said ignition tip to ignite said gas emitted from said jet nozzle and heat up said ignition element at the same time;

an ignition button slidably mounted on said ceiling of said casing in a vertical movable manner wherein said ignition button is attached to a top end of the piezoelectric unit and arranged in such a manner that when said ignition button is depressed downwardly, said movable operating part of said piezoelectric unit is depressed to ignite said piezoelectric jet lighter;

a lighter cap slidably mounted on said ceiling of said casing in such a radially movable manner for covering said opening of said nozzle housing in an air tight manner; and a visible flame arrangement, comprising:

a pair of gas emitting nozzles appearing on said nozzle housing for producing visible flames respectively, wherein said two gas emitting nozzles are respectively provided on a ceiling of said nozzle housing and positioned at two sides of said jet nozzle, wherein each of said gas emitting nozzles is an elongated tube vertically extended through said nozzle housing to a position closed with said ignition element in such a manner that when said ignition element is heat up, said gas emitted from said respective gas emitting nozzle is ignited to produce said visible flame; and a connecting means comprising a gas passage conduit extended from said gas releasable valve, a pair of gas discharging conduits extended from said gas emitting nozzles respectively, and a gas dividing valve connected between said gas passage conduit and said gas discharging conduits for detouring said gas passing from said gas passage conduit to said gas discharging conduits and said gas emitting nozzle individually;

wherein said releasable valve is a T-shaped valve joint having a gas inlet extended from said gas ejecting pipe and two gas outlets connected with said gas emitting conduit and said gas passage conduit respectively for selectively switching said gas discharged from said gas ejecting pipe to be detoured either through said gas emitting conduit for said jet nozzle to produce said jet flame or through said gas passage conduit for said gas emitting nozzles to produce said visible flames;

wherein said gas dividing valve is a tee joint valve having a gas entrance connected to said gas passage conduit and two gas exits connected to said gas discharging conduits respectively such that said gas discharged from said gas passage conduit is evenly divided into two portions to said pair of gas emitting nozzles respectively, wherein each of said gas emitting nozzles functions individually since said gas transported to said gas emitting nozzles are supported by said gas discharging conduit separately.

2. The piezoelectric jet lighter, as recited in claim 1, further comprising a gas adjustable button rotatably connected to said gas ejecting pipe for selectively adjusting said flow of gas, wherein said gas adjustable button is rotatably mounted on a bottom of said casing and arranged to adjust said flow of gas discharging from said gas ejecting pipe.

3. The piezoelectric jet lighter, as recited in claim 1, wherein said gas releasable valve further comprises a sealing wall, having a gas passage, sealedly mounted at said gas ejecting pipe, and regulating means comprising a gas releasable pusher supported at said gas passage, a gas stopper, having a spherical shaped, mounted at an entrance of said gas outlet that communicates with said gas passage conduit, and a compression spring supported at said entrance of said respective gas outlet for applying an urging pressure against said gas stopper so as to block said gas flowing towards said gas passage conduit in such a manner that when said gas releasable valve is lifted up, said gas stopper blocks said gas flowing towards said gas passage conduit so that said gas is released through said gas passage and detoured to flow towards said gas emitting conduit through said respective gas outlet communicating therewith, and when said gas releasable valve is dropped down, a bottom side of said gas inlet is sealedly supported on said sealing wall to block said gas flowing towards said gas emitting conduit, at the same time, said gas releasable pusher pushing said gas stopper upwardly to release a blocking of said respective gas outlet so that said gas is detoured to flow towards said gas passage conduit through said gas outlet communicating therewith.

4. The piezoelectric jet lighter, as recited in claim 3, wherein said gas releasable valve further comprises a sealing wall, having a gas passage, sealedly mounted at said gas ejecting pipe, and regulating means comprising a gas releasable pusher supported at said gas passage, a gas stopper, having a spherical shaped, mounted at an entrance of said gas outlet that communicates with said gas passage conduit, and a compression spring supported at said entrance of said respective gas outlet for applying an urging pressure against said gas stopper so as to block said gas flowing towards said gas passage conduit in such a manner that when said gas releasable valve is lifted up, said gas stopper blocks said gas flowing towards said gas passage conduit so that said gas is released through said gas passage and detoured to flow towards said gas emitting conduit through said respective gas outlet communicating therewith, and when said gas releasable valve is dropped down, a bottom side of said gas inlet is sealedly supported on said sealing wall to block said gas flowing towards said gas emitting conduit, at the same time, said gas releasable pusher pushing said gas stopper upwardly to release a blocking of said respective gas outlet so that said gas is detoured to flow towards said gas passage conduit through said gas outlet communicating therewith.

5. The piezoelectric jet lighter, as recited in claim 1, further comprising a gas detouring arrangement which comprises a passage seat supported in said casing while said gas passage conduit is rested on said passage seat, and a control latch extended from said gas lever to a position above said passage seat in such a manner that when said depressible end of said gas lever is depressed by said ignition button to drive said control latch downwardly, said control latch compresses said gas passage conduit with respect to said passage seat, so as to block said gas discharging through said gas passage conduit.

6. The piezoelectric jet lighter, as recited in claim 5, further comprising a valve positioning arrangement which comprises a switch latch extended from said lighter cap and arranged to be moved frontwardly when said lighter cap is radially slid rearwardly with respect to said casing, a resilient element having an affixing end portion securely mounted in said casing and a control end portion engaged with said switch latch, and a switch pusher mounted on said resilient element at a position towards said gas releasable valve, in such a manner that said switch pusher is arranged to bias a sidewall of said gas releasable valve to shut off said gas from releasing, to position underneath said gas releasable valve for detouring said gas to said jet nozzle when said gas passage conduit is compressed via said control latch, and to block said gas releasable valve at a bottom side thereof for detouring said gas to said gas emitting nozzles when said control latch is moved upwardly to releasing a blocking up of said gas passage conduit.

7. The piezoelectric jet lighter, as recited in claim 6, wherein said resilient element is a U-shaped elastic clip supported in said casing for applying an urging force against said switch pusher so as to push said switch pusher to bias said sidewall of said gas releasable valve, wherein when said ignition cap is in a closed position, said switch latch normally pulls said control end of said portion of said resilient element towards said affixing end thereof to retain said resilient element in a compressed manner.

8. The piezoelectric jet lighter, as recited in claim 7, further comprising a gas adjustable button rotatably connected to said gas ejecting pipe for selectively adjusting said flow of gas, wherein said gas adjustable button is rotatably mounted on a bottom of said casing and arranged to adjust said flow of gas discharging from said gas ejecting pipe.

9. A piezoelectric jet lighter for cigarette, cigar and pipe, comprising:

a casing having a liquefied gas storage;

a nozzle housing provided on a ceiling of said casing;

a jet nozzle received in said nozzle housing and communicating with said liquefied gas storage for producing a jet flame, wherein an ignition element is mounted on an opening of said nozzle housing at a position above said jet nozzle;

a gas ejecting pipe having a gas releasable valve extended from said liquefied gas storage for controlling a flow of gas wherein a gas emitting conduit is extended from said gas releasable valve to said jet nozzle;

a piezoelectric unit, which is disposed in said casing for generating piezoelectricity, comprising a movable operating part extended upwardly and an ignition tip extended to a position closed with said jet nozzle, wherein when said movable operating part is depressed downwardly, sparks are generated from said ignition tip to ignite said gas emitted from said jet nozzle and heat up said ignition element at the same time;

an ignition button slidably mounted on said ceiling of said casing in a vertical movable manner wherein said ignition button is attached to a top end of the piezoelectric unit and arranged in such a manner that when said ignition button is depressed downwardly, said movable operating part of said piezoelectric unit is depressed to ignite said piezoelectric jet lighter;

a lighter cap slidably mounted on said ceiling of said casing in such a radially movable manner for covering said opening of said nozzle housing in an air tight manner; and a visible flame arrangement, comprising:

a pair of gas emitting nozzles appearing on said nozzle housing for producing visible flames respectively, wherein said two gas emitting nozzles are respectively provided on a ceiling of said nozzle housing and positioned at two sides of said jet nozzle, wherein each of said gas emitting nozzles is an elongated tube vertically extended through said nozzle housing to a position closed with said ignition element in such a manner that when said ignition element is heat up, said gas emitted from said respective gas emitting nozzle is ignited to produce said visible flame; and a connecting means comprising a gas passage conduit extended from said gas releasable valve, a pair of gas discharging conduits extended from said gas emitting nozzles respectively, and a gas dividing valve connected between said gas passage conduit and said gas discharging conduits for detouring said gas passing from said gas passage conduit to said gas discharging conduits and said gas emitting nozzle individually.

10. The piezoelectric jet lighter, as recited in claim 9, wherein said gas releasable valve further comprises a sealing wall, having a gas passage, sealedly mounted at said gas ejecting pipe, and regulating means comprising a gas releasable pusher supported at said gas passage, a gas stopper, having a spherical shaped, mounted at an entrance of said gas outlet that communicates with said gas passage conduit, and a compression spring supported at said entrance of said respective gas outlet for applying an urging pressure against said gas stopper so as to block said gas flowing towards said gas passage conduit in such a manner that when said gas releasable valve is lifted up, said gas stopper blocks said gas flowing towards said gas passage conduit so that said gas is released through said gas passage and detoured to flow towards said gas emitting conduit through said respective gas outlet communicating therewith, and when said gas releasable valve is dropped down, a bottom side of said gas inlet is sealedly supported on said sealing wall to block said gas flowing towards said gas emitting conduit, at the same time, said gas releasable pusher pushing said gas stopper upwardly to release a blocking of said respective gas outlet so that said gas is detoured to flow towards said gas passage conduit through said gas outlet communicating therewith.

11. The piezoelectric jet lighter, as recited in claim 9, further comprising a gas detouring arrangement which comprises a passage seat supported in said casing while said gas passage conduit is rested on said passage seat, and a control latch extended from said gas lever to a position above said passage seat in such a manner that when said depressible end of said gas lever is depressed by said ignition button to drive said control latch downwardly, said control latch compresses said gas passage conduit with respect to said passage seat, so as to block said gas discharging through said gas passage conduit.

12. The piezoelectric jet lighter, as recited in claim 10, further comprising a gas detouring arrangement which comprises a passage seat supported in said casing while said gas passage conduit is rested on said passage seat, and a control latch extended from said gas lever to a position above said passage seat in such a manner that when said depressible end of said gas lever is depressed by said ignition button to drive said control latch downwardly, said control latch compresses said gas passage conduit with respect to said passage seat, so as to block said gas discharging through said gas passage conduit.

13. The piezoelectric jet lighter, as recited in claim 11, further comprising a valve positioning arrangement which comprises a switch latch extended from said lighter cap and arranged to be moved frontwardly when said lighter cap is radially slid rearwardly with respect to said casing, a resilient element having an affixing end portion securely mounted in said casing and a control end portion engaged with said switch latch, and a switch pusher mounted on said resilient element at a position towards said gas releasable valve, in such a manner that said switch pusher is arranged to bias a sidewall of said gas releasable valve to shut off said gas from releasing, to position underneath said gas releasable valve for detouring said gas to said jet nozzle when said gas passage conduit is compressed via said control latch, and to block said gas releasable valve at a bottom side thereof for detouring said gas to said gas emitting nozzles when said control latch is moved upwardly to releasing a blocking up of said gas passage conduit.

14. The piezoelectric jet lighter, as recited in claim 12, further comprising a valve positioning arrangement which comprises a switch latch extended from said lighter cap and arranged to be moved frontwardly when said lighter cap is radially slid rearwardly with respect to said casing, a resilient element having an affixing end portion securely mounted in said casing and a control end portion engaged with said switch latch, and a switch pusher mounted on said resilient element at a position towards said gas releasable valve, in such a manner that said switch pusher is arranged to bias a sidewall of said gas releasable valve to shut off said gas from releasing, to position underneath said gas releasable valve for detouring said gas to said jet nozzle when said gas passage conduit is compressed via said control latch, and to block said gas releasable valve at a bottom side thereof for detouring said gas to said gas emitting nozzles when said control latch is moved upwardly to releasing a blocking up of said gas passage conduit.

15. The piezoelectric jet lighter, as recited in claim 13, wherein said resilient element is a U-shaped elastic clip supported in said casing for applying an urging force against said switch pusher so as to push said switch pusher to bias said sidewall of said gas releasable valve, wherein when said ignition cap is in a closed position, said switch latch normally pulls said control end of said portion of said resilient element towards said affixing end thereof to retain said resilient element in a compressed manner.

16. The piezoelectric jet lighter, as recited in claim 14, wherein said resilient element is a U-shaped elastic clip supported in said casing for applying an urging force against said switch pusher so as to push said switch pusher to bias said sidewall of said gas releasable valve, wherein when said ignition cap is in a closed position, said switch latch normally pulls said control end of said portion of said resilient element towards said affixing end thereof to retain said resilient element in a compressed manner.

17. The piezoelectric lighter, as recited in claim 16, further comprising a gas adjustable button rotatably connected to said gas ejecting pipe for selectively adjusting said flow of gas, wherein said gas adjustable button is rotatably mounted on a bottom of said casing and arranged to adjust said flow of gas discharging from said gas ejecting pipe.

18. A process of igniting a piezoelectric jet lighter, comprising the steps of:

(a) opening a lighter cap wherein a gas releasable is positioned at a normal lowest position for shutting off a gas releasing from a liquefied gas storage in a casing;

(b) applying a downward force on an ignition button to lift up a gas releasable valve via a gas lever at a highest position for releasing gas through said gas releasable valve;

(c) applying a pushing force against a switch pusher to a position underneath said gas releasable valve;

(d) releasing said downward force on said ignition button, such that said gas releasable valve is dropped downwardly until said gas releasable valve is blocked by said switch pusher at a mid-position between said highest and lowest positions, in such a manner that said gas is capable of being detoured from said gas releasable valve either to a jet nozzle through a gas emitting conduit for producing a jet flame or a gas emitting nozzle through said gas passage conduit for producing a visible flame at said highest position and at said mid-position respectively; and (e) closing said lighter cap to move said switch pusher away from said gas releasable valve such that said gas releasable valve is allowed to further drop downwardly to said lowest position to shut off the gas discharged from said liquefied gas storage.

19. The process, as recited in claim 18, wherein said piezoelectric lighter further comprises a passage seat supported in said casing while said gas passage conduit is rested on said passage seat and a control latch extended from said gas lever to a position above said passage seat in such a manner that, in the step (b), when said depressible end of said gas lever is depressed by said ignition button to drive said control latch downwardly, said control latch compresses said gas passage conduit with respect to said passage seat, so as to block said gas discharging through said gas passage conduit.

20. The process, as recited in claim 19, wherein said piezoelectric jet lighter further comprises a switch latch extended from said lighter cap and arranged to be moved frontwardly when said lighter cap is radially slid rearwardly with respect to said casing and a resilient element having an affixing end portion securely mounted in said casing and a control end portion engaged with said switch latch, wherein said resilient element is adapted to apply said pushing force against said switch pusher towards said gas releasable valve.

21. The process as recited in claim 20, in step (d), wherein said control latch is moved upwardly to release a blocking up of said gas passage conduit so that said gas is detoured to said gas passage conduit for said gas emitting nozzle to produce said visible flame.

22. The process, as recited in claim 21, wherein said resilient element is a U-shaped elastic clip supported in said casing for applying said pushing force against said switch pusher so as to push said switch pusher to bias said sidewall of said gas releasable valve, wherein when said ignition cap is in a closed position in step (e), said switch latch normally pulls said control end of said portion of said resilient element towards said affixing end thereof to retain said resilient element in a compressed manner.

* * * * *